US007647721B1

(12) United States Patent
Gaber et al.

(10) Patent No.: US 7,647,721 B1
(45) Date of Patent: Jan. 19, 2010

(54) UNIVERSAL MULTIFUNCTIONAL COVER FOR QUICK-ACQUISITION OPTICAL SIGHT

(75) Inventors: Leonid Gaber, 2018 Gulfstream Way, San Leandro, CA (US) 94579; Dmitry Rocklin, San Francisco, CA (US); James Munn, Sausalito, CA (US)

(73) Assignee: Leonid Gaber, South San Francisco, CA (US)

( * ) Notice: Subject to any disclaimer, the term of this patent is extended or adjusted under 35 U.S.C. 154(b) by 0 days.

(21) Appl. No.: 12/286,728

(22) Filed: Oct. 2, 2008

(51) Int. Cl.
*F41G 1/38* (2006.01)

(52) U.S. Cl. ..... 42/129; 359/511

(58) Field of Classification Search ..... 42/129; 359/511

See application file for complete search history.

(56) References Cited

U.S. PATENT DOCUMENTS

| | | | | | |
|---|---|---|---|---|---|
| 2,849,795 | A | * | 9/1958 | Vissing | 42/129 |
| 3,496,642 | A | * | 2/1970 | Pfahler | 42/129 |
| 4,899,450 | A | * | 2/1990 | Huggins | 42/119 |
| 5,020,894 | A | * | 6/1991 | Weyrauch et al. | 359/511 |
| 5,150,528 | A | * | 9/1992 | Shire | 42/129 |
| 5,548,442 | A | | 8/1996 | Devenyi et al. | |
| 5,566,490 | A | * | 10/1996 | Owen | 42/90 |
| 5,784,195 | A | * | 7/1998 | Mac Collum | 359/511 |
| 5,924,234 | A | | 7/1999 | Bindon et al. | |
| 6,157,482 | A | * | 12/2000 | Koide | 359/408 |
| 6,226,880 | B1 | | 5/2001 | Pitre | |
| 6,487,809 | B1 | | 12/2002 | Gaber | |
| 6,811,268 | B2 | * | 11/2004 | Watson | 359/611 |
| 7,234,265 | B1 | | 6/2007 | Cheng et al. | |
| 7,484,856 | B1 | * | 2/2009 | Newhall et al. | 359/511 |

OTHER PUBLICATIONS

American Technologies Network Corp. produces as Doctor Optics under the trademark "TA01NSN-DOC: 4×32 Trijicon ACOG®", which is equipped with a quick-acquisition sight known as "7.0 MOA Docter®" which mounts in tandem with the Trijicon ACOG® scopes.

* cited by examiner

*Primary Examiner*—J. Woodrow Eldred
*Assistant Examiner*—Gabriel J Klein
(74) *Attorney, Agent, or Firm*—Urania Juang

(57) ABSTRACT

A universal multifunctional cover for a quick-acquisition optical sight in the form of a box-like casing with an open front end, which in the sight-closing position of the cover is located in front of the optical lens, and with a rear end closed with a transparent medium. The cover is provided with a frame that supports an optical filter and has a radial outward projection that can be used as a foresight. The frame is pivotally supported by stretchable resilient members such as rubber strings so that the frame with the foresight and the filter can be switched between the following three positions: a first position in which the frame rests on the box-like casing, a second position in which the frame is installed in front of the optical lens with the foresight projecting upward, and a third position in which the frame is installed in front of the optical lens with the foresight projecting downward and closing the sensor.

9 Claims, 5 Drawing Sheets

UNIVERSAL MULTIFUNCTIONAL COVER FOR QUICK-ACQUISITION OPTICAL SIGHT

FIELD OF THE INVENTION

The present invention relates to optical sights for weapons, measurement instruments, geological surveying instruments, or the like, and more specifically to a universal cover for a red-dot-enhanced quick-acquisition optical sight. The sight of this type can be used independently or in combination with a tubular optical scope.

BACKGROUND OF THE INVENTION

Varieties of sighting devices are known for aiming firearms and the like. Firearms typically employ two sights that are spaced from one another along a line substantially parallel to the path along which a projectile will be discharged. A user holds the firearm manually so as to view over and/or through the two spaced sights toward the target and then discharges the firearm. The user can manually or mechanically adjust for windage and elevation. In any event, the objective is to align the firearm accurately with the target by viewing along a line to the target, as defined by the spaced sights, and holding the firearm along that line.

Among various modern sights, a special group of sights is termed red-dot sights because they project a red dot within the field of view of the sight, thereby providing the shooter with fast target acquisition. In general, all known quick-acquisition optical sights can be roughly divided into sights of an open type and sights of a closed type. The sights of the open type are those that in use are open, i.e., exposed to the surrounding atmosphere, and are closed by a separate removable cover in an inoperative condition, e.g., during transportation or storage.

A conventional quick-acquisition optical sight with a removable protective cover is shown in FIG. 1, which is a three-dimensional view of a tubular optical scope 20 that supports a quick-acquisition optical sight 22 that is provided with a removable protective cover 24, which is shown by solid lines in a disconnected state above the scope 20 and by broken lines in a scope-covering state. In the scope-covering state, the protective cover, which is molded as a single piece from a plastic material, completely covers the lens 26 and the upper surface of the sight to protect the lens and the surface of the sight against accumulation of dust, dirt, etc., on the areas that are exposed to the environment during the use. In other words, when the cover closes the sight, the sight cannot be used. An example of an open-type sight is a quick-acquisition sight known as Doctor Optics (commercially produced by American Technologies Network, California under the trademark "TA01NSN-DOC: 4x32 Trijicon ACOG®"), which is equipped with a quick-acquisition sight known as "7.0 MOA Docter®" which mounts in tandem with the Trijicon ACOG® scopes. The compact tubeless design allows for a low weight without sacrificing performance. The TA01NSN-DOC combines the technology of the battle-tested Trijicon ACOG (4x32) gun sight with the Doctor Optic 7.0 MOA Red Dot Sight. This provides the shooter with the option of quick-acquisition close-range sighting with the Doctor Sight and the precision for longer range shooting with the Trijicon ACOG 4x32. This ability to adjust to tactical situations gives the user the needed edge when lives are on the line and success is the only acceptable outcome. The ranging reticle allows for bullet-drop compensation to 600 meters without manual adjustment. The reticle appears black during the daytime and glows amber in the dark, thanks to Trijicon's patented tritium illumination. The Doctor Sight offers a large field of view due to its low magnification and is firmly factory-adjusted parallax-free to 40 yards. This adjustment ensures that parallax-related aiming errors are minimized over a long-distance range.

The optics consists of two firmly connected glass lenses. The functionally important coating reflecting the aiming dot is applied to one of the inside surfaces, which provides maximum protection against scratches. Additionally, the outer surfaces of the lenses are antireflection-coated with resistant layers. All components and mounting elements exposed to mechanical stress are made of high-grade materials, such as stainless steel and hard-anodized aluminum alloys.

An advantage of the open-type optical sights is convenience of use and aiming at the target since such sights provide a wide angle of observation and improve quick-acquisition conditions. However, the disadvantage of all open-type optical sights provided with a red-dot aiming system is that during the use, they are open to the environment and are subject to contamination with dirt, dust, and other foreign particles which under severe conditions of use may destroy the optical elements, such as diodes, or the like. In order to protect the sights of this type from contamination, they are provided with a cover, an example of which is the cover 24 shown in FIG. 1.

Red-dot-enhanced sights of a closed type are protected from contamination of optical elements by tubular housing. However, such sights are less convenient to use because they have a narrow angle of observation and are slower in acquisition of a target.

An example of an optical sight of a closed type is an internal red-dot sight disclosed in U.S. Pat. No. 7,234,265 issued in 2007 to L. Cheng, et al. The sight includes an objective lens formed from a convex lens, a planar eye lens set at a tilt angle relative to the objective lens and facing the concave surface of the objective lens, and a light-emitting device set between the planar eye lens and the objective lens and controlled to emit a point light source onto the eye lens for enabling the eye lens to reflect the point light source and to further produce a virtual point light source on the focal point of the objective lens for viewing by the user.

Another example of a closed optical sight provided with red-dot aiming features is a sight disclosed in U.S. Pat. No. 6,487,809 issued to L. Gaber in 2002. This device possesses the same drawbacks as other sights of the closed type.

Another common disadvantage of the quick-acquisition sights of all types is that they are normally not provided with optical filters; thus, aiming at a target in the direction against the sun presents a problem since the viewer is blinded. Of course, the filters can be used at any time if necessary, but such filters are not always readily available, are stored in a separate casing, and cannot be immediately attached to the lens of the sight, which sometimes may be very inconvenient in a combat situation.

The red-dot-enhanced optical sights are normally provided with a brightness-adjustment sensor, which is always in the ON condition. Sometimes, however, the scene of the target is so bright, e.g., when shooting in the direction of direct sunrays, that operation becomes useless. When the sensor is ON, it consumes a significant amount of energy of the master battery. In some situations it may be required to temporarily reduce the energy consumed by the sight sensor by closing the sensor opening, but the existing scopes are not provided with convenient means for quickly opening or closing the sensor opening. Furthermore, a removable cover can be lost because if it is not attached to the optical sight and is stored in a separate place when the latter is not in use.

OBJECTS AND SUMMARY OF THE INVENTION

It is an object of the present invention to provide a universal multifunctional cover for a red-dot-enhanced quick-acquisition sight that is equipped with a switchable element that is constantly present on the sight and can be switched between three positions that provide the sight with different functions. It is another object to provide the sight of the aforementioned type wherein the switchable element can be switched between an operation position that provides the sight lens with a filter, a position that reduces the energy consumed by a sight sensor and provides quick-acquisition sight with a foresight (front sight), and a position in which the switchable element is placed into an inoperative state on the sight without violation of its main operational function. It is a further object to provide a universal multifunctional cover of the aforementioned type that always can be held on the sight and that keeps the sight closed while maintaining it in a normal operational state.

The universal multifunctional cover for a red-dot-enhanced quick-acquisition sight comprises a box-like casing with a closed upper wall, flat side walls, closed rear wall formed by a transparent protective glass, and an open front wall. The terms "front" and "rear" define the distal and proximal sides of the cover when it is placed into a sight-closing position at which the front or distal end is the farthest from the viewer's eye and the rear or proximal end is the nearest to the viewer's eye. In fact, in its shape and dimensions, the sight cover of the invention is the same as conventional completely closed protective covers provided for quick-acquisition sight, e.g., for TA01NSN-DOC: 4x32 Trijicon ACOG®. Pivotally attached to both sidewalls of the cover are elongated resilient elements, or arms, that are longitudinally stretchable, e.g., rubber strings or expandable springs. The free ends of these stretchable arms pivotally support a frame with a filter. One transverse side of the aforementioned frame has a radial outward extension that may be used as a foresight of the sight. While being pivotally supported by the free ends of the stretchable elements, the other ends of these elements are pivotally attached to the sight housing so that the frame with the filter and foresight can be easily installed into various positions by pulling the frame away and stretching the resilient elements far enough from the front end of the sight to freely rotate the frame relative to the front wall of the resilient arms and to turn the frame together with the resilient elements relative to the sight housing. Thus, when the filter and foresight are not used, the frame can be placed in a horizontal position onto the top surface of the cover where it is secured in the above position by the compression force of the resilient elements, which in this position are stretched. When the user aims at a target located at high elevation and toward the sun, he/she stretches the resilient elements in the outward direction, turns the stretched arms towards the sight lens, and at the same time rotates the frame around the pivots on the free ends of the stretched elements. When in this condition the frame is turned into position with the foresight extending in the upward direction from the lens, the sight sensor opens, the diode projects a visible red dot onto the lens, and the filter closes the lens. In this state, aiming at a target can be carried out by using the red dot, the foresight, or both. When the user wishes to reduce the energy consumed by the sensor and to switch off the red dot, he/she pulls the stretchable elements, moves the frame forward, and rotates the frame by 180° to a position in which the foresight turns down and closes the opening of the sensor. In that case the red dot is not shown on the lens, and the energy of the master battery is saved. At the same time, the cover closes and protects the sight from contamination with particles of dirt, dust, etc. A situation as such may occur when the firearm is not in use and is either stored or transported.

DETAILED DESCRIPTION OF THE INVENTION

Figure 1:
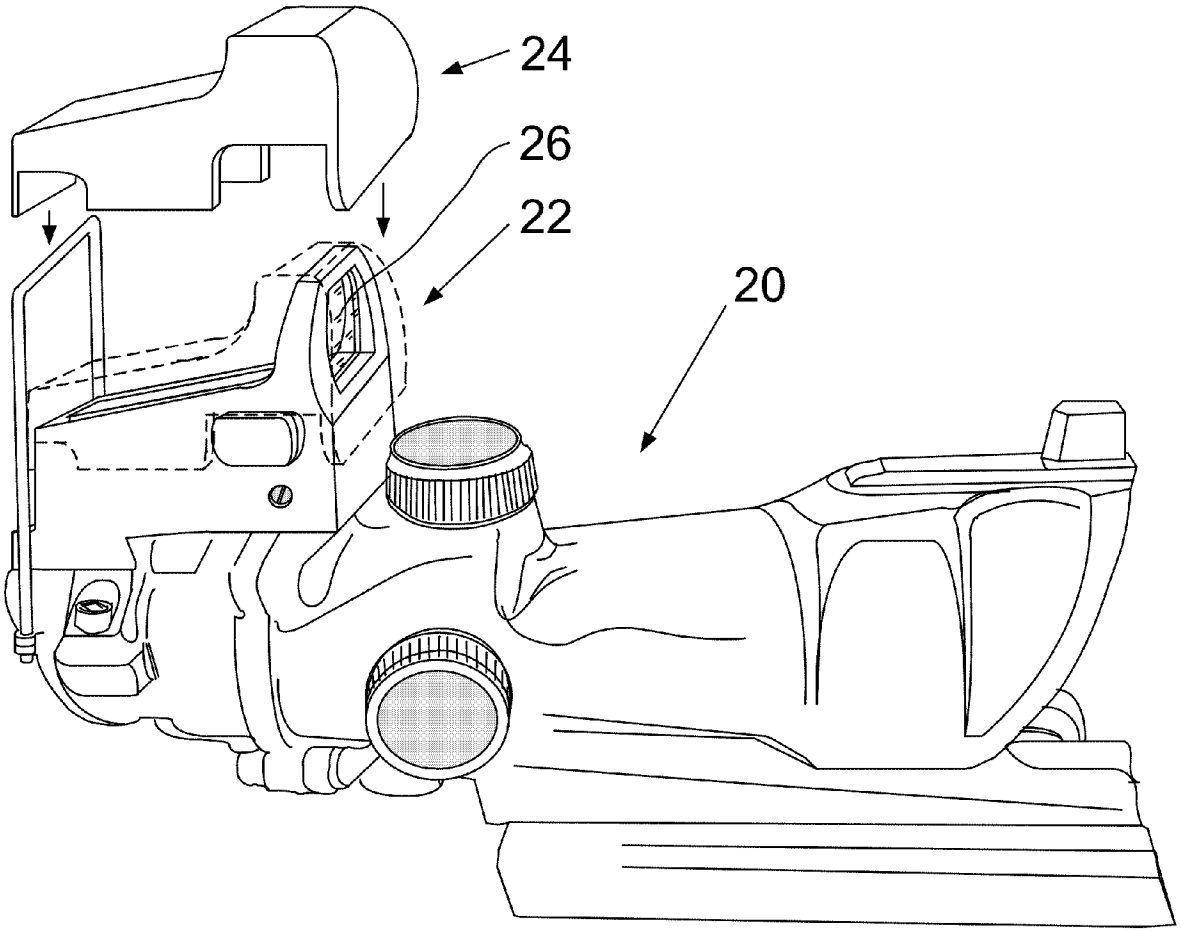
FIG. 1 PRIOR ART
FIG. 1 is a three-dimensional view of a tubular optical scope that supports the quick-acquisition optical sight provided with a conventional removable protective cover, which is shown by solid lines in a disconnected state above the scope and by broken lines in the scope-covering state.
Figure 2:
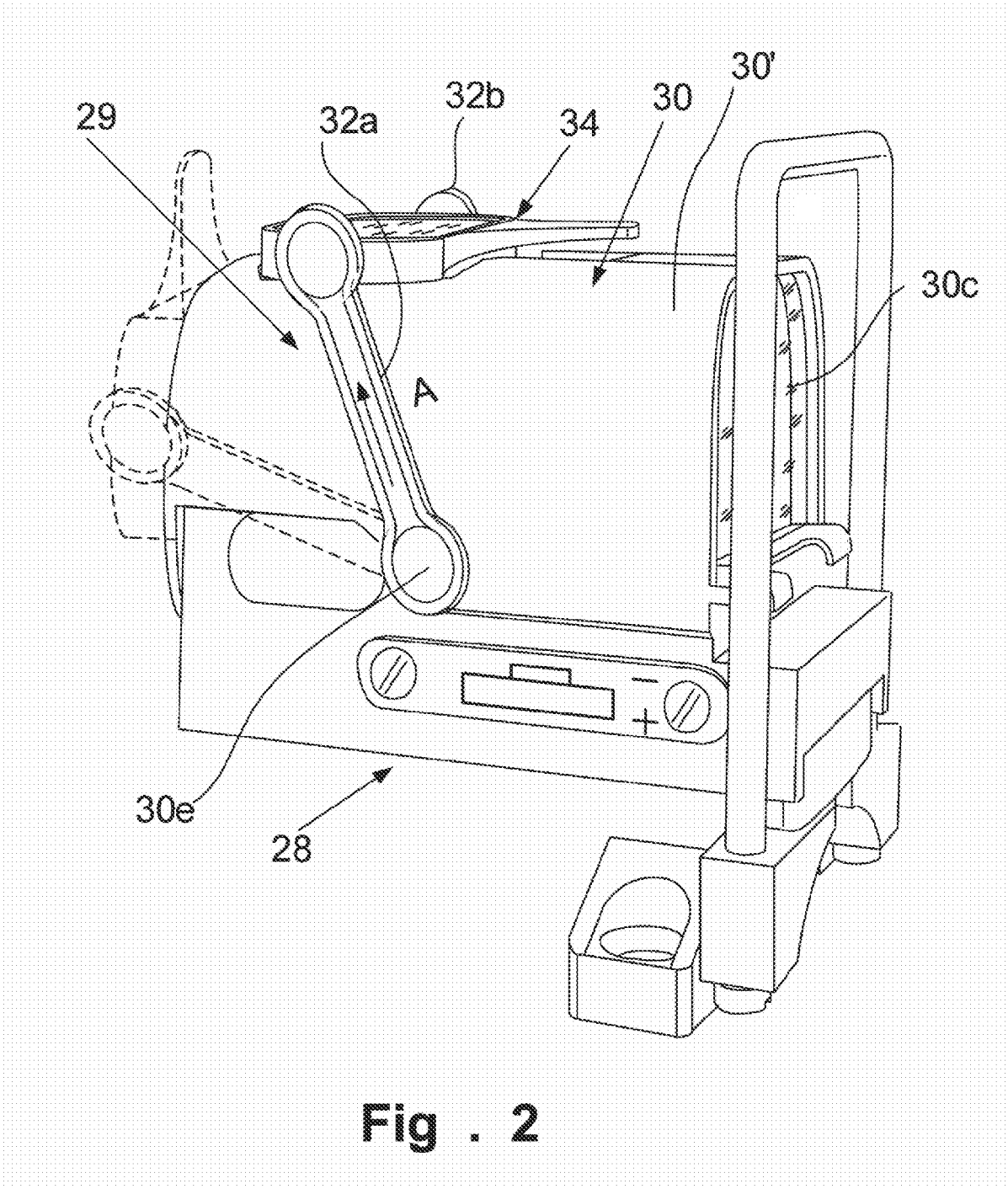
FIG. 2 is a three-dimensional view of the quick-acquisition optical sight with the cover of the invention wherein the frame of the switchable element is shown in the horizontal position resting on the top of the cover with the foresight facing rearward.
Figure 3:
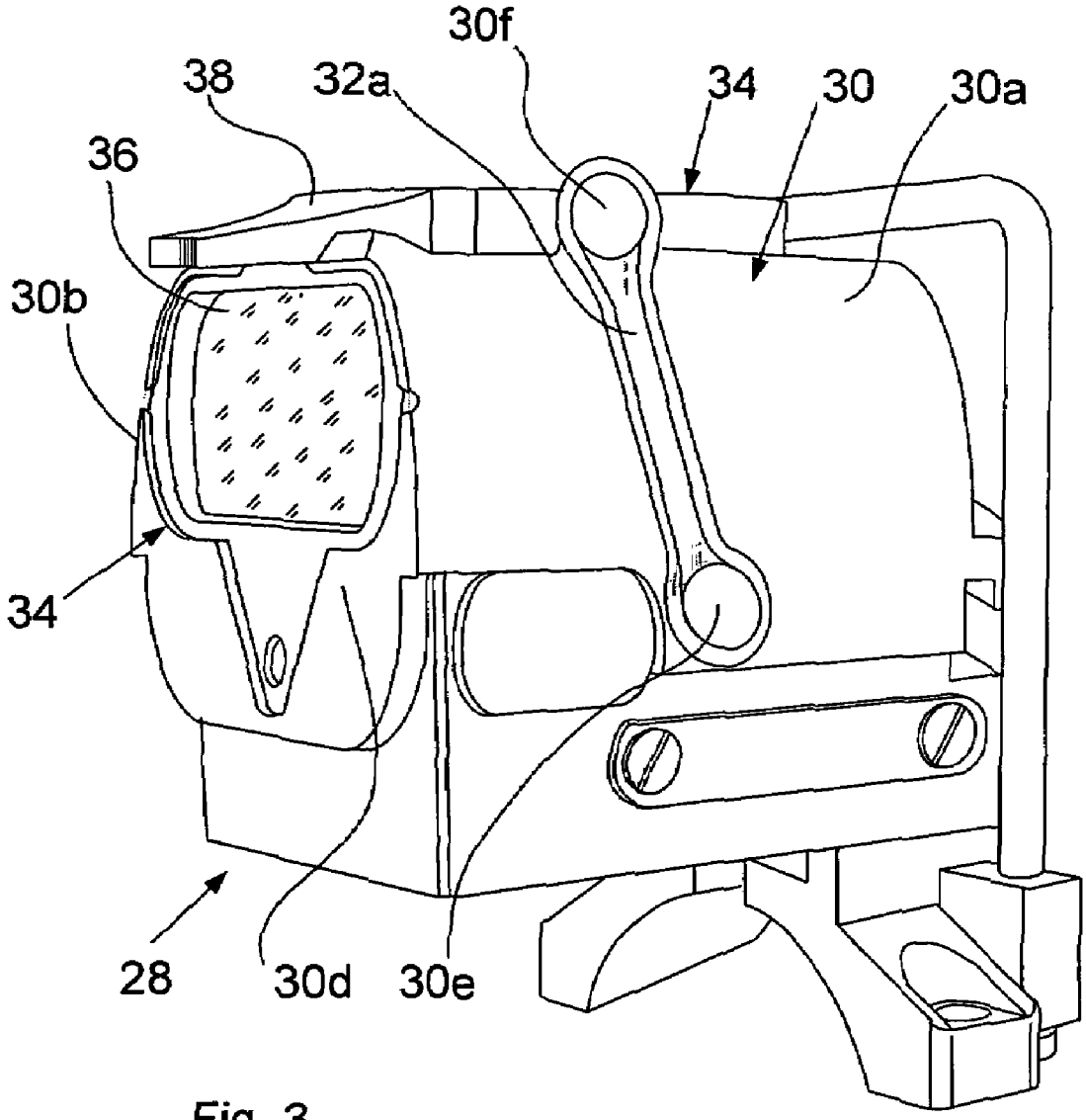
FIG. 3 is a view similar to FIG. 2 but with the foresight facing forward.
Figure 4:
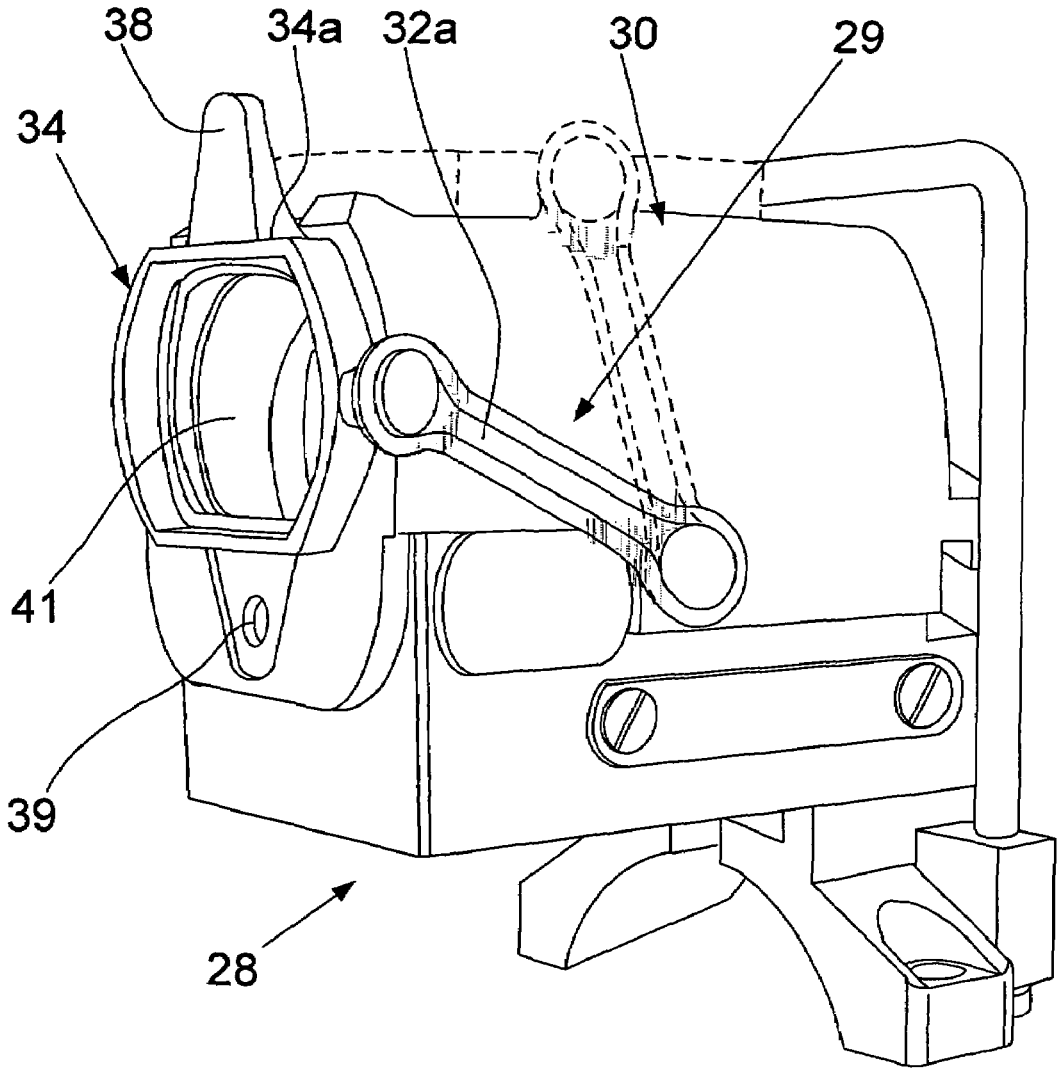
FIG. 4 is a three-dimensional view of the sight with the frame of the switchable element shown in the vertical position, with the optical filter in front of the sight lens, and with the foresight projecting upward, i.e., in the working position.
Figure 5:
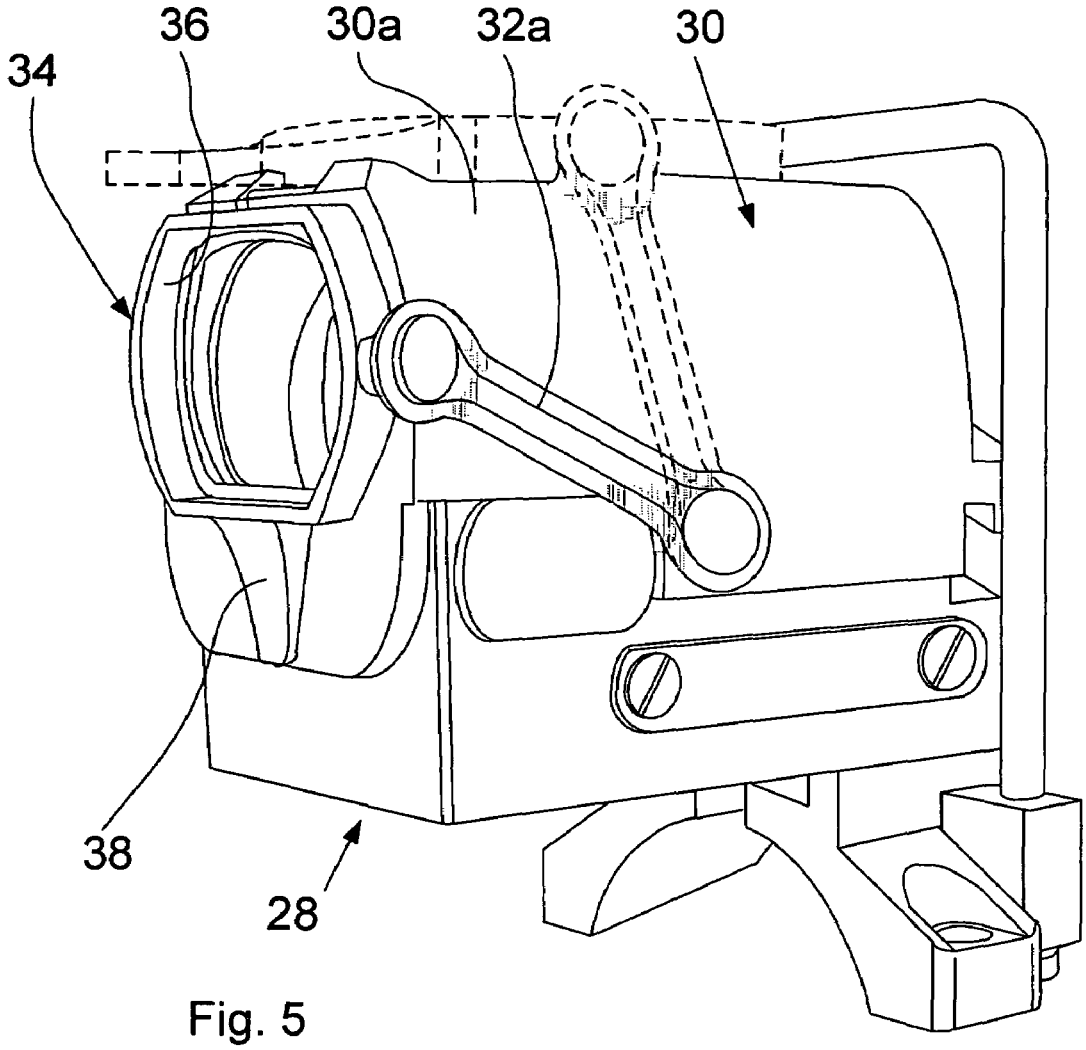
FIG. 5 is a three-dimensional view of the sight with the switchable element frame shown in the vertical position, with the optical filter in front of the sight lens, and with the foresight projecting downward into the position that closes the opening of the sight sensor.

A universal multifunctional cover of the present invention for a red-dot-enhanced quick-acquisition sight 28 (FIGS. 2 to 5) will now be described in more detail with reference to the accompanying drawings, wherein FIG. 2 is a three-dimensional view of a quick-acquisition optical sight with a cover of the invention wherein the frame of the switchable element is shown in the horizontal position resting on the top of the cover with the foresight facing rearward. FIG. 3 is a view similar to FIG. 2 but with the foresight facing forward. FIG. 4 is a three-dimensional view of the sight with the frame of the switchable element shown in the vertical position with the optical filter in front of the sight lens and with the foresight projecting upward, i.e., in the working position. FIG. 5 is a three-dimensional view of the sight with the frame of the switchable element shown in the vertical position, with the optical filter in front of the sight lens, and with the foresight projecting downward into the position that closes the opening of the sight sensor.

A universal multifunctional cover 30 of the present invention for a red-dot-enhanced quick-acquisition sight 28 (hereinafter referred to as "the cover") comprises a box-like casing (FIGS. 2 to 5) with a closed upper wall 30', flat side walls 30*a* and 30*b* (FIG. 3), a closed rear wall formed by a transparent medium, e.g., a transparent plastic plate or a glass plate 30*c* (FIG. 2), an open front wall 30*d*, and an open bottom (FIG. 3). The terms "front" and "rear" define the distal and proximal sides of the cover 30 when it is placed into the sight closing position at which the front or distal end is the farthest from the viewer's eye and the rear or proximal end is nearest to the viewer's eye. In fact, in its shape and dimensions, the sight cover 30 of the invention is the same as conventional completely closed protective covers provided for quick-acquisition sight, e.g., for TA01NSN-DOC: 4x32 Trijicon ACOG®.

Pivotally attached to both side walls 30*a* and 30*b* of the cover at pivot 30*e* (FIG. 3) and a similar pivot on the other side (not seen in the drawings) are elongated resilient elements, or arms, 32*a* and 32*b*, which are stretchable in the longitudinal direction A of the arms (FIG. 2), e.g., rubber strings or expandable springs. The free ends of these stretchable arms pivotally support on pivot 30*f* (FIG. 3) and on a similar pivot on the other side of the sight (not seen in the drawings) a frame 34 with an optical filter 36 (FIG. 3). One transverse side 34*a* (FIG. 4) of the aforementioned frame 34 has a radial outward extension that may be used as a foresight 38 (FIG. 4) of the sight 28. While pivotally supported by the free ends of stretchable elements 32*a* and 32*b*, the other ends of these elements are pivotally attached to the side walls 30*a* and 30*b* of the cover 30 (FIG. 2) so that the frame 34 with the filter 36 (FIG. 3) and the foresight 38 (FIG. 4) can be easily installed into various positions by pulling the frame 34 away in direction A (FIG. 2) and stretching the resilient elements 32*a* and 32*b* far enough from the front end of the sight 28 for freely rotating the frame 34 relative to the front walls of the resilient arms 32*a* and 32*b* and for turning the frame 34 together with the resilient elements 32*a* and 32*b* relative to the cover 30.

Thus, when the filter and foresight are not used, the frame 34 can be placed in the horizontal position onto the top surface 30' of the cover where it is secured in the above position by the compression force of the resilient elements 32*a* and 32*b*, which in this position are stretched (FIG. 2). In FIG. 2 the foresight 38 is shown facing rearward. The same condition is obtained when the frame is turned in the counterclockwise direction so that the frame can be supported by the top of the cover 30 with the foresight facing forward, as shown in FIG. 3.

When the user aims at a target located at high elevation and toward the sun, he/she stretches the resilient arms 32*a* and 32*b* in the outward direction of arrow A (FIG. 2), turns the stretched arms 32*a* and 32*b* on pivots, such as the pivot 30*e* towards the sight end, and at the same time rotates the frame 34 with the filter 36 around the pivots, such as the pivot 30*f* (FIG. 3) on the free ends of the stretched arms 32*a* and 32*b*. When in this condition the frame is turned into position with the foresight 38 extending in the upward direction from the lens (FIG. 4), the sight sensor opening 39 (FIG. 4) opens, the diode projects a visible red dot onto the lens 41 (FIG. 4), and the lens is closed by the filter 36. In this state, aiming at a target can be carried out by using the red dot, the foresight, or both. When the user wishes to reduce the energy consumed by the sensor and to switch the red dot off, he/she pulls the stretchable elements 32*a* and 32*b*, moves the frame 34 forward, and rotates the frame 34 by 180° to a position (FIG. 5) in which the foresight 38 is turned down and closes the opening 39 of the sensor. In that case the red dot is not shown on the lens, and the energy of the master battery is saved. At the same time, the sight 28 is kept closed and protected by the cover from contamination with particles of dirt, dust, etc.

Thus it has been shown that the invention provides a universal multifunctional cover for a red-dot-enhanced quick-acquisition sight that is intended for installation on a tubular scope and is equipped with the switchable element 29, which is constantly present on the sight 28 and can be switched between three positions that provide the sight with different functions. The switchable element 29 can be switched between an operation position that provides the sight lens with a filter 36, a position that reduces the energy consumed by a sight sensor and provides the quick-acquisition sight 28 with a foresight (front sight) 38, and a position in which the switchable element 29 is placed into an inoperative state on the sight 28 without violation of its main operational function. The universal multifunctional cover 30 of the aforementioned type can always be held on the sight to keep the sight closed while maintaining it in a normal operational state.

Although the invention has been shown and described with reference to specific embodiments, it is understood that these embodiments should not be construed as limiting the areas of application of the invention and that any changes and modifications are possible provided that these changes and modifications do not depart from the scope of the attached patent claims. For example, the sight 28 can be installed not necessarily on a firearm scope but on a tubular optical surveying instrument. The cover may have a rounded or a rectangular cross section. The cover can be molded from a plastic or stamped from a metal sheet material. The cover can be attached to the sight of different types and shapes provided that they have standardized features for connection and disconnection of the cover. Filters in the frame of the switchable element can be replaceable. The stretchable elements scan be made from rubber strings or can be made in the form of coil springs.

The invention claimed is:

1. A universal multifunctional cover for a quick-acquisition optical sight provided with a sensor and an optical lens, the universal multifunctional cover comprising: a box-like casing with a closed upper wall, side walls, a rear wall closed with a transparent medium, an open front wall, and an open bottom; and a multifunctional switchable element that is pivotally connected to said side walls and comprises a frame and that can be switched between an inoperative position, in which said frame rests on the closed upper wall of the casing, and an operative position, in which the frame is installed in front of the open front wall, wherein said frame supports an optical filter and a foresight so that in said operative position of the switchable element the optical filter is installed in front of said optical lens; wherein the frame is pivotally connected to the side walls by means of stretchable resilient elements, one end of each said stretchable resilient element being pivotally connected to a respective side wall and an opposite end of each said stretchable resilient element pivotally supporting the frame such that it is possible to rotate the frame relative to the stretchable resilient elements and thus relative to said open front wall; and wherein the frame is provided with a foresight that extends radially outward from the frame and can be turned into a first position in which the foresight extends upward for use as a foresight or a second position in which the foresight extends downward and closes said sensor.

2. The universal multifunctional cover according to claim 1, wherein the frame is provided with a foresight that extends radially outward from the frame and can be turned into a first position in which the foresight extends upward for use as a foresight or a second position in which the foresight extends downward and closes said sensor.

3. The universal multifunctional cover according to claim 2, wherein the transparent medium is a glass plate.

4. A universal multifunctional cover for a quick-acquisition optical sight provided with a sensor and an optical lens, the universal multifunctional cover comprising: a box-like casing with side walls; an open front end; a rear end closed with a transparent medium; a frame with a foresight in the form of a radial outward projection and an optical filter; and a pair of stretchable resilient members, one end of each said stretchable resilient member being pivotally connected to a respective side wall and an opposite end of each said stretchable resilient member pivotally supporting the frame such that it is possible to rotate the frame relative to the stretchable resilient members; wherein said frame can be switched between the following three positions by stretching said stretchable resilient members and by rotating the frame relative to said box-like casing: a first position in which the frame rests on the box-like casing, a second position in which the frame is installed in front of the optical lens with the foresight projecting upward, and a third position in which the frame is installed in front of the optical lens with the foresight projecting downward and closing said sensor.

5. The universal multifunctional cover of claim 4, wherein said frame supports the optical filter.

6. The universal multifunctional cover of claim 5, wherein the transparent medium is a glass plate or a transparent plastic plate.

7. The universal multifunctional cover of claim 4, wherein the stretchable resilient members are rubber strings.

8. The universal multifunctional cover of claim 5, wherein the stretchable resilient members are rubber strings.

9. The universal multifunctional cover of claim 6, wherein the stretchable resilient members are rubber strings.

* * * * *